US005960494A

United States Patent [19]

Gilliland et al.

[11] Patent Number: 5,960,494

[45] Date of Patent: Oct. 5, 1999

[54] FACIAL SUPPORT MASK ACCOMMODATING PRONE POSITION SURGERY

[76] Inventors: Grant D. Gilliland, 2731 Lemmon Ave. E. #304, Dallas, Tex. 75204; Thaddeus H. Ashmore, 3600 Gaston Ave. #409, Dallas, Tex. 75246; Guy D. Gilliland, 13040 Magnolia Crescent Dr., Roswell, Ga. 30075

[21] Appl. No.: 08/885,635

[22] Filed: Jun. 30, 1997

[51] Int. Cl.[6] ..... A47C 20/02; A47C 27/08

[52] U.S. Cl. ..... 5/638; 5/644; 5/713

[58] Field of Search ..... 5/622, 636, 637, 5/638, 644, 652.2, 655.3, 713; 128/205.25, 206.26

[56] References Cited

U.S. PATENT DOCUMENTS

| | | | |
|---|---|---|---|
| 2,047,216 | 7/1936 | McKesson | 128/206.26 |
| 4,504,050 | 3/1985 | Osborne | 269/328 |
| 4,752,064 | 6/1988 | Voss | 269/328 |
| 4,898,164 | 2/1990 | Baumberg | 128/202.18 |
| 4,918,774 | 4/1990 | Popitz | 5/441 |
| 4,947,500 | 8/1990 | Seiler | 5/713 |
| 4,971,051 | 11/1990 | Toffolon | 128/202.26 |
| 5,044,026 | 9/1991 | Matthews | 5/435 |
| 5,184,365 | 2/1993 | Stafford | 5/632 |
| 5,220,699 | 6/1993 | Farris | 5/636 |
| 5,269,035 | 12/1993 | Hartunian | 5/638 |
| 5,287,576 | 2/1994 | Fraser | 5/637 |
| 5,520,623 | 5/1996 | Williams | 602/17 |
| 5,685,036 | 11/1997 | Kopfstein et al. | 5/713 |
| 5,815,864 | 10/1998 | Sloop | 5/713 X |

*Primary Examiner*—Terry Lee Melius
*Assistant Examiner*—James M. Hewitt
*Attorney, Agent, or Firm*—Dennis T. Griggs

[57] ABSTRACT

During a surgical procedure being performed on a patient in the prone (face down) position, the patient's head and face are supported by a facial support mask having two or more contoured cushions that are independently inflatable and deflatable with respect to each other. The inflatable cushions are sequentially pressurized and depressurized, thus providing continuous, soft support for the patient's head, while alternatively relieving compression forces applied to pressure-sensitive facial areas. Alternately pressurizing and depressurizing the inflatable cushions shifts the location of compressive forces, thus relieving compressed tissues and permitting recovery of normal blood circulation in sensitive facial tissues. The patient's head, neck and face are not disturbed while the support cushions are cycled through various pressurization and depressurization states.

13 Claims, 5 Drawing Sheets

FACIAL SUPPORT MASK ACCOMMODATING PRONE POSITION SURGERY

BACKGROUND OF THE INVENTION

This invention relates generally to patient support apparatus, and in particular to method and apparatus for protecting a patient's head, neck and face during a surgical procedure that is performed while the patient is lying in a prone position or seated leaning forward.

During some surgical procedures, it is necessary to support a patient in the prone (face down) position on an operating table. For example, the prone position is used during the following procedures: back surgery, laminectomies, fusions, instrumentations, scoliosis surgery, hemorrhoidectomies, colorectal surgery, Achilles tendon repair, decubitus ulcer debridement, myocutaneous flaps, hip surgery, neck surgery, spinal tumors, removal of Baker's cysts, calcaneal fractures and the like.

A continuing difficulty facing the medical practitioner, when positioning the patient so that pressure is exerted on his face, is avoiding injury to the patient's head and face. There are many well-known complications that can occur if the patient's face and head are not positioned or supported properly. These complications result from the continued interruption of blood flow to soft tissue areas, and include the following: soft tissue necrosis and sloughing with possible infection, necrosis of the cartilaginous support structures of the nose and ear, corneal ulceration, conjunctival edema, blindness, central or branch retinal artery occlusion, and increased intraocular pressure. During the course of surgery in the prone position, it is necessary to monitor the vital structures of the patient's face every few minutes so that facial injury caused by compression of soft, sensitive facial tissue can be avoided.

Moreover, the patient's head must be positioned and his airway must be properly aligned to accommodate endotracheal instruments used to administer general anesthetics and oxygen during major surgical procedures.

A variety of support arrangements have been proposed for supporting a patient's face and head while the patient is lying in a prone position. Typically, the patient's head and face are supported between two or more foam cushions, pillows or towels, with the support members being manually repositioned every few minutes to relieve the accumulation of pressure on the patient's sensitive facial tissues. This support arrangement has obvious disadvantages in that it requires an attendant's close attention to carefully shift the resting position of the patient's head while maintaining airway alignment with tracheal intubation equipment. Proper management of intubation equipment is restricted by the placement of supporting cushions or towels that obscure the observation of facial features.

One approach that provides facial support while also allowing close observation and airway management is disclosed in U.S. Pat. No. 5,220,699. According to that disclosure, a contoured, inflatable mask is mounted on a rigid basket that supports a patient's head and face while the patient is lying in a prone position. The surgical face mask uses an inflatable chamber for providing soft, cushion support for the patient's forehead and face. An advantage of that arrangement is that the pressure of facial engagement is spread over a relatively large, contoured surface. However, the soft facial tissues are subject to compression injury in that arrangement, since the facial area of engagement remains unchanged over a relatively long period of time, thus causing the continuous interruption of blood flow to those soft tissue areas and various resulting damage.

Another prone support arrangement is disclosed in U.S. Pat. No. 5,287,567 in which a patient's chin and forehead are supported on an inflatable chin support pad and an inflatable forehead support pad. The soft tissues of the patient's forehead and chin are subjected to compression injury and interruption of blood circulation since the areas of skin contact remain unchanged throughout the procedure.

A similar arrangement for facial support in the prone position is described in U.S. Pat. No. 5,520,623. In that arrangement, a forehead pad and a chin pad (neither of which is inflatable) are supported on a rigid basket frame which maintains the patient's face elevated above a support surface during a surgical procedure.

Another facial support for a patient lying in the prone position is disclosed in U.S. Pat. No. 5,269,035 in which a block of soft, closed cell foam is contoured for conforming, resilient support of the patient's head and face. U.S. Pat. Nos. 4,504,050 and 4,752,064 also disclose head support devices for supporting a patient's face in the prone position. Those support devices are not inflatable and impose a continuous compression force on sensitive facial, neck and head areas while also maintaining the patient's head in a fixed position.

Yet another head support arrangement is shown in U.S. Pat. No. 5,044,026 in which a face pillow is formed by two sponge cylinders that are coupled together in spaced relation to permit a patient to lie face down in a prone position with a ventilation passage being formed adjacent the patient's mouth and nostrils.

Other support arrangements are known for patients needing full body support to prevent pressure sores, decubitus ulcers, and head and shoulder support while the patient is in the supine position. For example, U.S. Pat. No. 5,184,365 discloses inflatable support bags that are pressurized for the purpose of aligning the patient's mouth, pharynx and trachea to accommodate tracheal intubation in the supine position.

BRIEF SUMMARY OF THE INVENTION

The problems related to continuous or static compression (in terms of duration and facial location) of soft facial tissue imposed by prior art support devices are overcome according to the present invention by a facial support mask having two or more contoured cushions that are inflatable and deflatable for providing shifting, soft support for the patient's head, while alternately relieving pressure applied to pressure-sensitive facial, neck and head areas. The cushions are inflatable and deflatable independently of each other temporally and spatially, so that resting pressure imposed on sensitive head, neck and facial regions is relieved by alternately pressurizing and depressurizing the contoured support cushions. Moreover, the duration of resting support for a particular facial location is controllable over variable intervals, thus providing intermittent as well as discontinuous spatial support for the patient's head, neck and face.

Pressurized (compressed) air is automatically supplied to the cushions during predetermined inflation cycles by a controller that controls the switching action of two-way and three-way control valves. The pressurized cushions are alternately vented during predetermined deflation cycles by a controller that controls the switching action of two-way and three-way control valves. The inflation, deflation and inflation overlap sequences are manually adjustable, and pressure sensors confirm the pressurization and depressurizing of each cushion.

The principal support mode of operation is intermittent non-overlapping time interval pressurization of the cushions. In the preferred embodiment, a specific sequence of pressurization and depressurization sequences is provided. In one of those sequences, both cushions are simultaneously pressurized. However, at no time are both cushions simultaneously deflated. The reason for simultaneous pressurization as well as alternating pressurization of the support cushions is to maintain the head of the patient in a steady position during the transition from one sequence to the next.

In the preferred embodiment, the cushions are constructed of soft, resilient tubular membranes. Preferably, the membranes are transparent so that the anesthesiologist or surgeon can monitor the patient's face, pressure-sensitive areas, anesthesia equipment and breathing circuit. The controller is programmable to provide sequential pressurization/depressurization of the inflatable cushions, as well as providing simultaneous inflation of both cushions. By this arrangement, the inflation/deflation sequence and inflation/deflation intervals are programmable to provide periodic relief of compression forces by shifting the areas of facial engagement from one contoured cushion to the other, and by varying the duration of pressure application for each cushion. This technique minimizes the localized, time-integrated application of pressure that is detrimental to the patient.

The multiple inflatable cushion arrangement, in which the cushions are independently pressurizable and deflatable with respect to each other, satisfies the specific need for a facial support for safely supporting a patient's head and face while the patient is in a prone position, and also is compatible with endotracheal anesthesia. The frequency of shifting support is manually adjustable as needed, but otherwise the inflatable cushion assembly operates automatically, thus permitting the attendant to focus his attention on the patient's vital signs while managing anesthesia equipment.

The features and advantages of the present invention will be further appreciated by those skilled in the art upon reading the detailed description which follows with reference to the drawings, wherein:

DETAILED DESCRIPTION OF THE INVENTION

Figure 1:
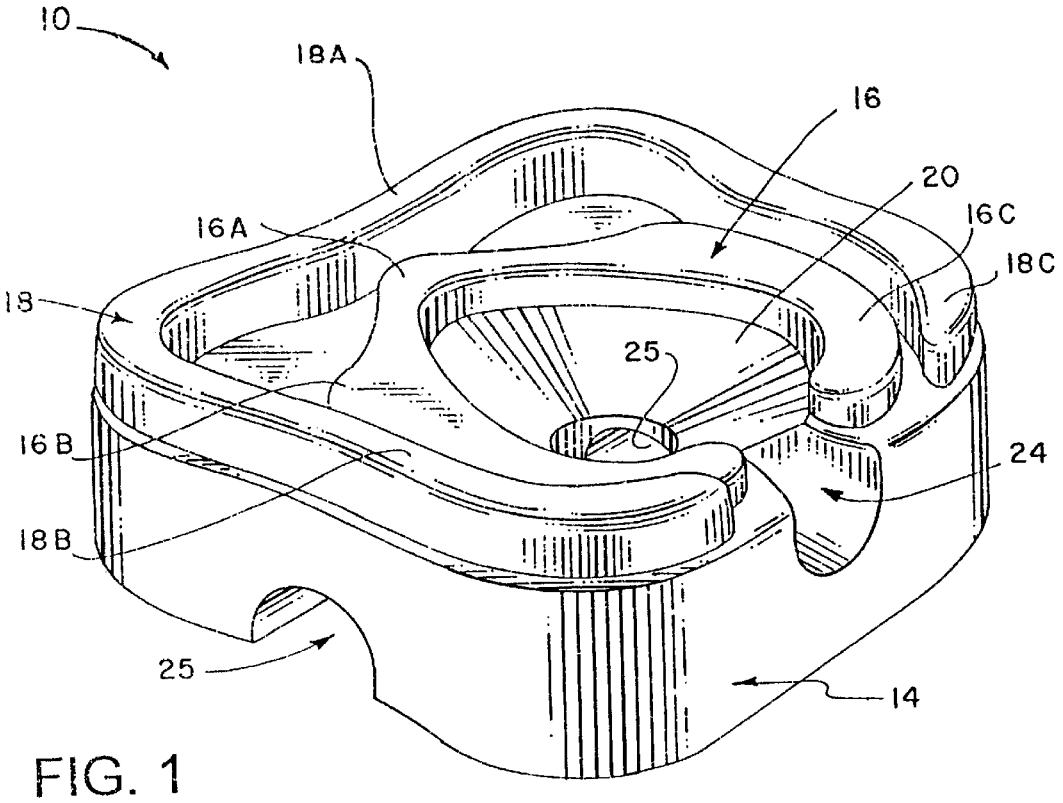
FIG. 1 is a perspective view of a facial support device including multiple inflatable cushions for use during prone anesthesia.

In the description which follows, like parts are indicated throughout the specification and drawings with the same reference numerals, respectively. The drawings are not necessarily to scale and the proportions of certain parts have been exaggerated to better illustrate certain structural features.

Figure 2:
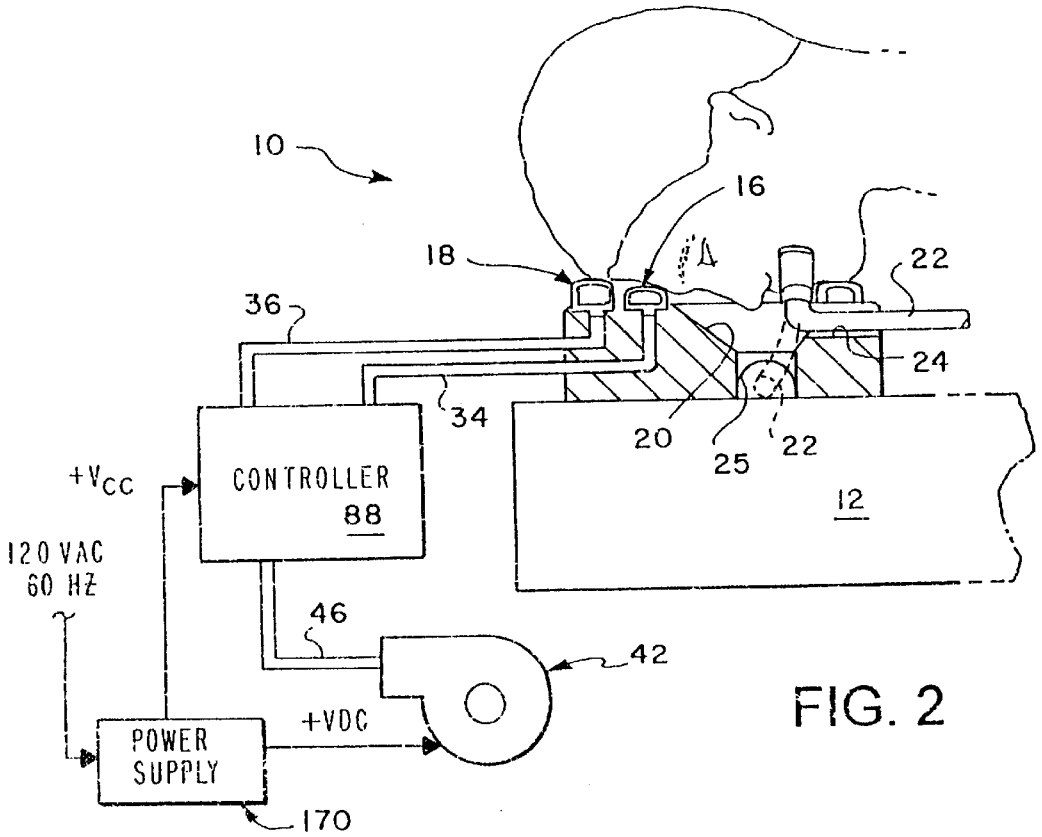
FIG. 2 is a simplified schematic view showing a patient's head in the prone position being supported by the facial support device of FIG. 1, and showing the interconnection of an air compressor and controller for controlling the pressurization and depressurization of the inflatable support cushions.

Referring now to FIG. 1 and FIG. 2, a facial support mask 10 constructed according to the present invention is particularly well-suited for use in combination with a conventional surgical operating table 12 for supporting the head and face of a patient in a prone position during the performance of various surgical procedures and/or while the patient is receiving anesthesia.

The facial support mask 10 includes as its principal components a base member 14 and first and second inflatable cushions 16, 18. The base member 14, in combination with the inflatable cushions 16, 18 support the patient's head and face above the support surface of the operating table 12. The combined height of the base member 14 and fully pressurized, inflatable cushions 16, 18 is selected to provide a comfortable elevation and orientation of the patient's head in the prone position.

The base member 14 is preferably constructed of a moldable, durable material, for example polyvinylchloride (PVC). Other moldable materials such as polyethylene and polyurethane may also be used. Preferably, the material selected for the base member 14 should be durable, rigid, transparent and adherable to the support cushions. The base member 14 is intersected by a large conical cavity 20 which provides clearance for portions of the patient's face as well as for an endotracheal tube 22. The base member 14 is also intersected by a transverse notch 24 and a transverse notch 25 that permit the endotracheal tube to be routed caudally or laterally across the operating table 12 from the patient's mouth to an external connection to ventilation equipment.

Figure 3:
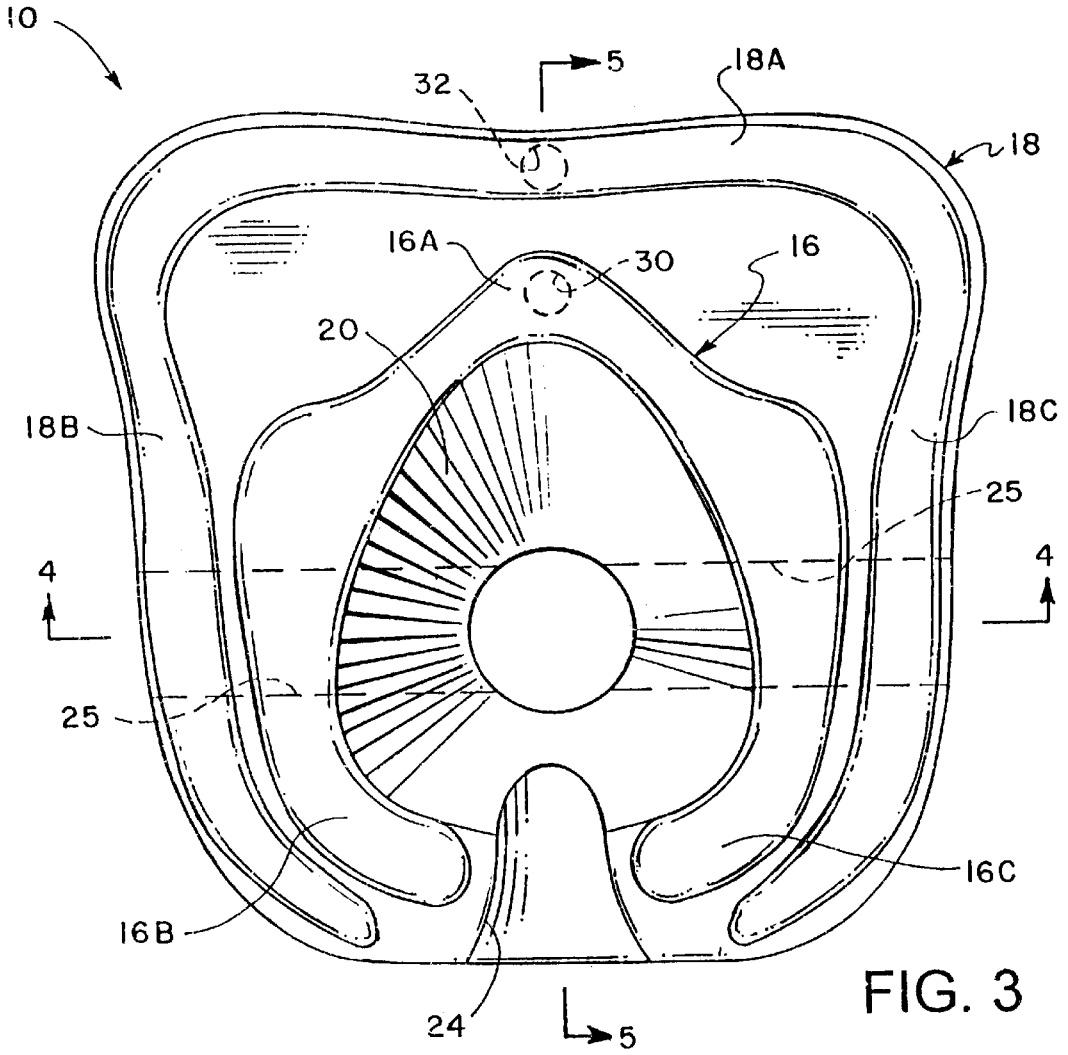
FIG. 3 is a top plan view of the facial support device shown in FIG. 1.
Figure 4:
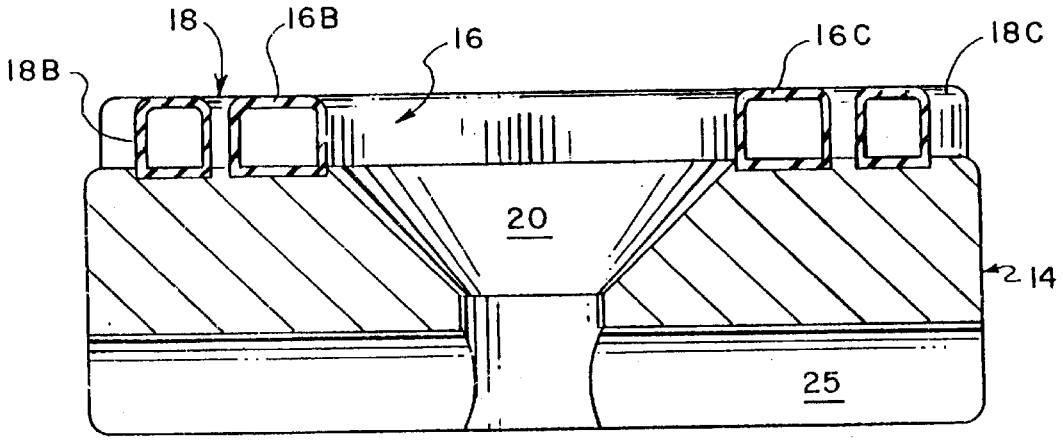
FIG. 4 is a sectional view thereof, taken along the lines 4—4 of FIG. 3.

Referring now to FIGS. 3 and 4, the inflatable cushions 16, 18 are fabricated from a multi-component, plastic material such as vinyl, silicone rubber, urethane or the like that is approved for medical use. Each cushion preferably is in the form of a thin, transparent plastic tube or membrane that is capable of safely operating at inflation pressures up to 30 psi or more. Moreover, each cushion is curved and contoured to at least partially encircle the cavity 20, and the outer cushion 18 at least partially encircles both the inner cushion 16 and the cavity 20. For this purpose, the inner inflatable cushion 16 is provided with a curved crown portion 16A and wing portions 16B, 16C that are curved for a close conforming fit with the forehead and side portions of a patient's head and face.

As shown in FIG. 2, the inner cushion 16 may at least partially engage the bridge of the patient's nose. The outer inflatable cushion 18 is provided with a crown portion 18A and wing portions 18B, 18C that are radially spaced with respect to the inner inflatable cushion 16. The cushions are curved and contoured so that they do not engage sensitive structures of the head and neck, such as the eye and the tip of the nose.

The crown and wing portions of the inner and outer inflatable cushions 16, 18 are curved and contoured for a close conforming fit along different sets of facial surface areas, respectively. According to this radially spaced relationship, each cushion is arranged so that it can, by itself, fully support the patient's head and face, but with different facial and forehead portions of the patient being supported by the each inflatable cushion.

According to an important feature of the invention, the cushions 16, 18 are independently inflatable and deflatable with respect to each other, so that the resting pressure forces imposed on sensitive facial and forehead regions of the patient are intermittently relieved by alternately pressurizing and depressurizing the contoured support cushions 16, 18. In the preferred embodiment, the inflatable cushions 16, 18 are sequentially pressurized and depressurized, thus providing continuous, soft support for the patient's forehead and face, while alternately relieving compression forces applied to pressure-sensitive facial areas.

Alternately pressurizing and depressurizing the inflatable cushions 16, 18 shifts the location of the compressive forces, thus relieving pressure on compressed tissues and permitting recovery of normal circulation in sensitive tissues. The time interval duration of pressurization and depressurization is also mutually adjustable for each cushion during a programmable sequence, as described below. This shifting, variable pressure and intermittent pressurization arrangement does not disturb the resting position or elevation of the patient and/or the patient's head during surgery.

Figure 5:
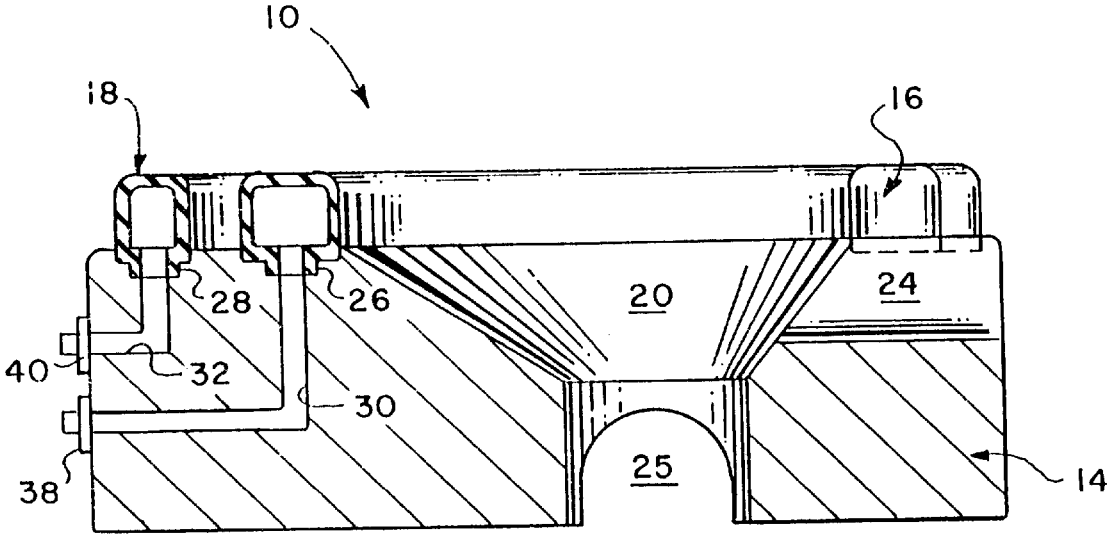
FIG. 5 is a sectional view thereof, taken along the lines 5—5 of FIG. 3.

Referring now to FIG. 2 and FIG. 5, the inflatable cushions 16, 18 are provided with connector fittings 26, 28 which are received within air passages 30, 32 for attachment to supply conduits 34, 36, respectively. The air passages 30, 32 are terminated by quick connect couplings 38, 40, respectively, which are connectable to the supply conduits 34, 36 as shown in FIG. 6.

Figure 6:
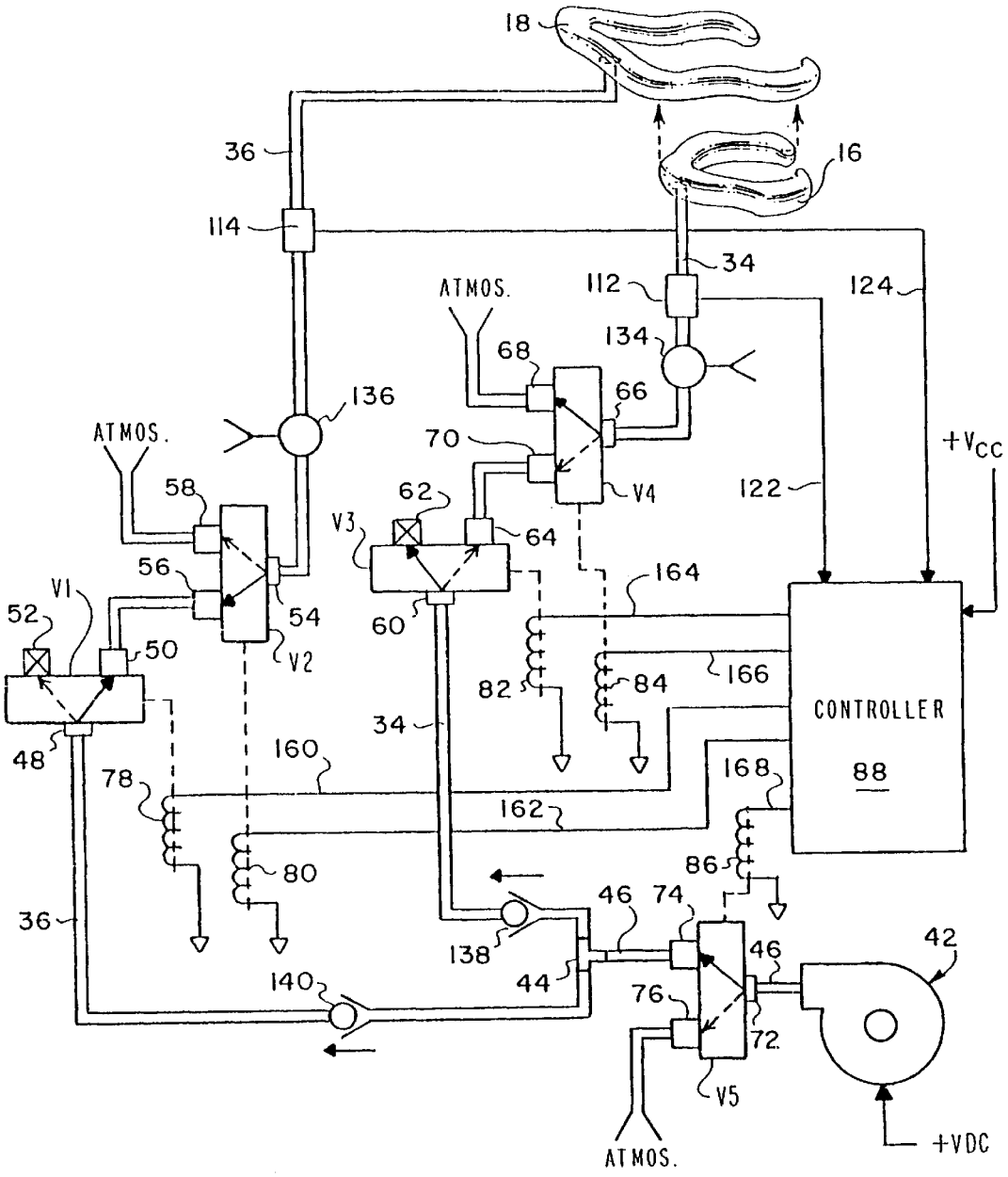
FIG. 6 is a simplified schematic diagram showing the interconnection of valves and pneumatic conduits in an automatic sequencing embodiment; and, FIG. 7 is a simplified electrical block diagram of the controller shown in FIG. 6.

Referring now to FIG. 2 and FIG. 6, the supply conduits 34, 36 are coupled to a source of compressed air, such as a pneumatic compressor 42, by a tee coupling 44 and a common supply conduit 46. Preferably, the compressor 42 is a low cost, low noise and reliable air compressor having a rated output of approximately 0.5 scfm with a maximum pressure of 30 psi, for example Model No. 007CDC19, manufactured by Thomas Corporation and distributed by Tool Systems, Inc. Pressurized (compressed) air produced by the compressor 42 is selectively applied to the inflatable cushions 16, 18 through flow control valves V1, V2, V3, V4 and V5. According to an alternative embodiment, the pressurized (compressed) air is supplied from one or more portable compressed air canisters through a pressure regulator to provide approximately 0.5 scfm at a maximum pressure of 30 psi.

The flow control valves V1, V2, V3, V4 and V5 are two-position, three-port flow valves, commonly referred to as two-way or three-way valves, depending on the number of active outlet ports available. The power-off, unswitched position of each valve is selected to be "normally open" or "normally closed" depending on the switching logic used by the controller. Suitable flow control valves can be obtained from Clippard Minimatic of Cincinnati, Ohio, distributed by Cross Sales & Engineering Co. of Norcross, Georgia. The preferred model numbers are ET-2-12-L (two-way valves) and ETO-3-12-L and ET-3-12-L (three-way valves). As used herein, the terms "unswitched" and "switched" as used in connection with the flow control valves V1, V2, V3, V4 and V5 refer to the power-off valve position (unswitched) indicated by the solid arrow, and the power-on solenoid-actuated valve position (switched) indicated by the dashed arrow.

Each flow control valve has a single inlet port with switched and unswitched outlet ports. Thus, the two-way flow control valve V1 has an inlet port 48, an unswitched outlet port 50 and a switched outlet port 52 (blocked). Likewise, the three-way flow control valve V2 has an inlet port 54, an unswitched outlet port 56 and a switched port 58. The two-way flow control valve V3 has an inlet port 60, an unswitched outlet port 62 (blocked) and a switched outlet port 64. The flow control valve V4 has an inlet port 66, an unswitched outlet port 68 and a switched outlet port 70. The flow control valve V5 has an inlet port 72, an unswitched outlet port 74 and a switched outlet port 76.

The flow control valves V1, V2, V3, V4 and V5 are mechanically and electrically coupled for independent shifting actuation by separate solenoids 78, 80, 82, 84 and 86. Pressurization and depressurization of the cushions 16, 18 are thus performed independently of each other.

In the preferred embodiment as represented by FIG. 6, the flow control valves V1, V2, V3, V4 and V5 are coupled between the compressor 42 and the inflatable cushions 16, 18 for selectively pressurizing the inflatable cushions independently with respect to each other, and for selectively releasing pressurized air from the inflatable cushions 16, 18 independently of each other. This is made possible by connecting the unswitched outlet ports 50, 56 of the flow control valves V1, V2 in air flow communication with each other, with the switched outlet port 52 of the flow control valve V1 being closed, and the switched outlet port 58 of the flow control valve V2 being open to atmosphere.

The flow control valves V3, V4 control the application of pressurized air to the inflatable cushion 16, and are similarly connected. According to this valving arrangement, when the flow control valves V1, V2 and V5 are in the unswitched positions as shown in FIG. 6, an air flow passage is established between the main supply conduit 46 of the compressor and the supply conduit 36 which supplies pressurized (compressed) air to the inflatable cushion 18. When the flow control valves V1, V2 are actuated to the switched position, pressurized air is permitted to vent through the supply conduit 36 and through the inlet port 54 of the flow control valve V2 through the outlet port 58 which is open to the atmosphere. In the switched position, the flow control valve V1 is shifted to the closed outlet port 52, thereby interrupting the flow of compressed air from the compressor 42 to the outer cushion 18.

During the outer cushion pressurization interval, air in the inner inflatable cushion 16 is vented through the supply conduit 34, through the inlet port 66 of flow control valve V4 and into the atmosphere through the unswitched outlet port 68, which is open to the atmosphere. Compressed air from the compressor 42 that is delivered to the flow control valve V3 through supply conduit 34 is blocked by the closed outlet port 62 of valve V3. When the flow control valves are switched, compressed air in the outer inflatable cushion 18 is permitted to vent into the atmosphere through the open outlet port 58 of flow control valve V2, while the inner inflatable cushion 16 is pressurized through the switched outlet port 64 of flow control valve V3, the switched outlet port 70 and inlet port 66 of flow control valve V4.

Figure 7:
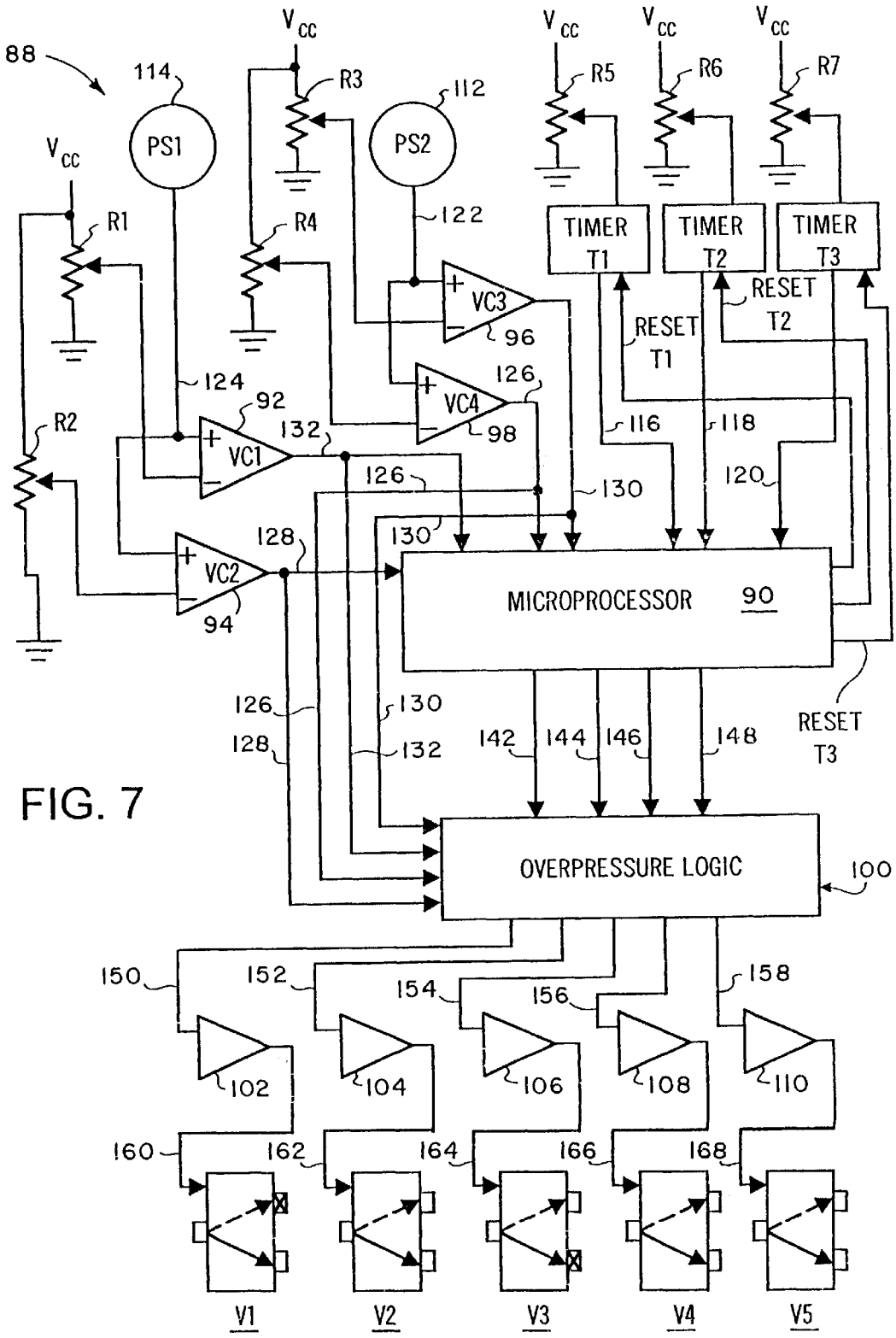

Referring now to FIG. 2, FIG. 6 and FIG. 7, the inflatable cushions 16, 18 are pressurized and depressurized automatically by a controller 88. The controller 88 includes as its principal components a microprocessor 90 that performs sequencing operations according to instructions stored in an electrically programmable read-only memory (EPROM). Sequencing operations are coordinated by three interval timers T1, T2 and T3, four voltage comparators 92, 94, 96 and 98, an over-pressure logic circuit 100 and five solenoid output drivers 102, 104, 106, 108 and 110.

The microprocessor 90 receives input logic signals 126, 128, 130 and 132 that indicate the under-pressure/over-pressure threshold conditions of the pressure sensors 112, 114 that are connected in flow communication in the supply conduits 34, 36, respectively. The microprocessor also receives timing logic signals 116, 118 and 120 that are output by the timers T1, T2 and T3. The pressure sensors 112, 114 are analog transducers, for example model number PX139-030D4V, distributed by Omega Engineering, Inc.

The non-inverting (+) inputs of the logic comparators 92, 94, 96 and 98 are connected to the analog voltage outputs 122, 124 of the pressure sensors 112 and 114. The switching thresholds of the voltage comparators 92, 94, 96 and 98 are adjusted by variable resistors R1, R2, R3 and R4 which are coupled to a supply voltage $V_{CC}$. The resistors R1, R2, R3 and R4 form voltage divider circuits that provide reference voltages on the inverting (−) inputs of the voltage comparators. Each reference voltage is set to correspond with a desired threshold operating pressure and maximum operating pressure within the inflatable cushions 16, 18, for example 15 psi and 30 psi, respectively.

The comparator logic output signals 126, 128 are at logic low when the inflatable cushions are under-inflated (below 15 psi) and the logic outputs are at logic high when the inflation pressure of the cushions equals or exceeds the preset minimum level, for example 15 psi. The comparator logic output signals 130, 132 are at logic low when the inflation pressure of the cushions are below the preset maximum level, for example 30 psi, and are at logic high when the internal pressure of the cushions equals or exceeds the preset level.

Poppet valves 134 and 136 serve as pressure relief valves and are connected in flow communication within the supply conduits 34, 36, respectively, to automatically vent the supply conduits when the pressure in those lines exceed a predetermined safe operating pressure for the inflatable cushions, for example 30 psi. The three-way flow control valve V5 automatically vents the main supply line 46 when the pressure in the main supply line exceeds a safe operating level.

The pressure sensing transducers 112, 114 provide analog feedback signals 122, 124 proportional to inflation pressure in each support cushion to the controller 88. The controller 88 is operable under the control of programmed instructions stored in the EPROM to conduct a driver enable signal 158 for actuating the flow control valve V5 to the switched (vent) position. This prevents "deadhead" damage to the compressor 42. Check valves 138, 140 decouple the cushions 16, 18 with respect to pressure surges caused by switching of flow control valves V1, V2.

The timers T1, T2 and T3 produce alternating logic high and logic low signals on signal conductors 116, 118 and 120, respectively, corresponding with predetermined pressurizing and depressurizing intervals. An operating program stored within the EPROM of the microprocessor 88, in response to the logic inputs 116, 118, 120, 126, 128, 130 and 132, provides TTL-logic output signals 142, 144, 146 and 148 to the over-pressure logic circuit 100 for independently and selectively actuating the flow control valves V1, V2, V3, V4 and V5. The EPROM operating programs also provides timer reset signals RESET T1, RESET T2 and RESET T3 for resetting each of the three timers.

The over-pressure logic circuit 100 provides logic low or logic high output signals 150, 152, 154, 156 and 158, for controlling the solenoid operation of drivers 102, 104, 106, 108 and 110, respectively. The solenoid drivers are preferably TTL-logic buffers with open-collectors, rated for high voltage service (a few tens of volts), for example Model 74LS07, manufactured by National Semiconductor Corporation. In response to the logic high input, the solenoid drivers produce analog output voltage signals 160, 162, 164, 166 and 168 that actuate the solenoids 78, 80, 82, 84 and 86 to the switched positions.

The controller 74 is implemented by TTL digital logic circuits and linear analog circuits. The principal component of the controller circuit is the EPROM memory chip that is designed to store a programmable sequence. In the two-cushion embodiment of this invention, there are eight distinct states in the main sequence. A digital counter (as a part of a sequencer circuit) steps the stored program through the sequence. The step from one state to the next is determined by the states of the three timers T1, T2 and T3 and the logic signals from the voltage comparators 92, 94, 96 and 98. The logic outputs 150, 152, 154, 156 and 158 control the flow control valves (V1–V5) and logic outputs, designated as RESET T1, RESET T2, and RESET T3 in FIG. 7, reset and enable the timers T1, T2 and T3. These outputs are established by the programmable EPROM such that the timers are enabled in the following sequence: T1, T3, T2, T3, T1, T3, T2, T3, followed by repetition of the sequence. In each of these steps, the logic outputs are defined to be either TTL logic-high or TTL logic-low so as to achieve the desired valving sequence.

Timer T1 controls the time duration of pressurization of a single cushion (either one). During the time when timer T1 is "counting", only one cushion is pressurized. Timer T2 controls the time interval in which both cushions are pressurized. Timer T3 controls the time duration allowed for switching of the valves. The flow control valves V1–V5 have a switching time of a few milliseconds, and the timer T3 allows sufficient time overlap for the flow control valves to change state before enabling the next sequence step.

The pressure transducers 112, 114 are coupled to the supply conduits 34, 36 leading to the cushions 16, 18. The analog signals 122, 124 from the pressure transducers (voltage linearly proportional to the pressure) are then input to the reference voltage divider circuits for each transducer. The comparator circuits 92, 96 are designed to undergo a switching transition from logic low to logic high when the cushions are sufficiently pressurized to support the patient's head. The comparator circuits 94 and 98 are designed to change state when the cushions are pressurized near the maximum allowable pressure for the cushions, to prevent rupturing of the cushions. The comparator circuits are identical, except that the set-points (reference voltages) for the comparators are controlled independently.

In order to prevent a condition known as "dead-heading" of the air compressor 42 (forcing air into a fixed volume at the maximum operating pressure of the compressor) while maintaining pressurization of the appropriate cushions, the flow control valves V1, V3 are switched to interrupt the flow of compressed air from the compressor 42 to the cushions 16, 18 in response to an over-pressure condition. The over-pressure logic circuit 100 is designed to allow a flow control valve to close only if it is previously open and its associated cushion is indicating an over-pressure condition. When an over-pressure condition is indicated, compressed air from the air compressor 42 is vented to the outside atmosphere to prevent damage to the compressor. This is accomplished by actuating flow control valve V5.

The pneumatic compressor 42 and the principal analog and digital components of the controller 88 are supplied with appropriate DC operating voltages by a DC power supply 170 which converts AC operating power supplied from an external source at 120 VAC, 60 Hz to the various DC voltage levels required, for example +15 VDC and −15 VDC for operation of the comparators, $+V_{CC}$ for operation of the voltage divider circuits, +5 VDC for operation of light emitting diodes (LEDs), +12 VDC for operation of the solenoids and +12 VDC for operation of the air compressor 42.

Although a preferred embodiment of the invention has been described in detail herein, those skilled in the art will recognize that various substitutions and modifications may be made without departing from the scope and spirit of the invention as recited in the appended claims.

We claim:

1. Apparatus for supporting a patient's forehead and face comprising, in combination:

a first inflatable cushion for engaging a first surface area of a patient's forehead or face;

a second inflatable cushion for engaging a second surface area of a patient's forehead or face; and, apparatus coupled to the first and second inflatable cushions for selectively pressurizing and depressurizing the first and second inflatable cushions so that the first inflatable cushion is pressurized during a first time interval, and the second inflatable cushion is pressurized during a second time interval.

2. Apparatus for supporting a patient's forehead and face during a medical or surgical procedure comprising, in combination:

a base member having a cavity providing clearance for portions of a patient's forehead or face;

a first inflatable cushion mounted on the base member;

a second inflatable cushion mounted on the base member and being spaced from the first inflatable cushion;

a compressor for supplying compressed air to the first and second inflatable cushions; and, control apparatus coupled to the compressor and to the first and second inflatable cushions for selectively pressurizing either the first inflatable cushion or the second inflatable cushion with compressed air from the compressor, and for selectively releasing compressed air from either the first inflatable cushion or the second inflatable cushion.

3. Support apparatus as defined in claim 2, including a first supply conduit coupled in flow communication with the first inflatable cushion;

a second supply conduit coupled in flow communication with the second inflatable cushion;

the compressor being coupled to the first and second supply conduits for supplying pressurized air to the first inflatable cushion and the second inflatable cushion, respectively;

first valve means connected in the first supply conduit for selectively opening and closing air flow communication between the compressor and the first inflatable cushion; and, second valve means connected in the second supply conduit for selectively opening and closing air flow communication between the compressor and the second inflatable cushion.

4. Support apparatus as defined in claim 3, the first valve means including first and second two-position three-port flow control valves, the first and second flow control valves each having an inlet port and switched and unswitched outlet ports; and the inlet port of the first flow control valve being coupled in air flow communication with the compressor, the inlet port of the second flow control valve being coupled in air flow communication with the first inflatable cushion, the unswitched outlet ports of the first and second flow control valves being coupled in air flow communication with each other, the switched outlet port of the first flow control valve being closed, and the switched flow port of the second flow control valve being open to the atmosphere.

5. Support apparatus as defined in claim 3, the second valve means including third and fourth two-position, three-port flow control valves, the third and fourth flow control valves each having an inlet port and switched and unswitched outlet ports;

the inlet port of the third flow control valve being coupled in air flow communication with the compressor, the inlet port of the fourth flow control valve being coupled in air flow communication with the second inflatable cushion, the switched outlet ports of the third and fourth flow control valves, respectively, being coupled in air flow communication with each other, the unswitched outlet port of the third flow control valve being closed, and the unswitched outlet port of the fourth flow control valve being open to the atmosphere.

6. Apparatus for supporting a patient's forehead and face during a medical or surgical procedure comprising:

a first inflatable cushion having portions adapted for engaging the patient's forehead or face;

a second inflatable cushion having portions adapted for engaging the patient's forehead or face;

a source of compressed air for supplying compressed air to the first and second inflatable cushions; and control apparatus coupled to the compressed air source and t o the first and second inflatable cushions for selectively admitting compressed air into either one of the first and second inflatable cushions and for selectively venting compressed air out of either one of the first and second inflatable cushions.

7. Support apparatus as defined in claim 6, wherein the control apparatus comprises:

first and second valve means coupled between the compressed air source and the first and second inflatable cushions, respectively, for selectively opening and closing air flow communication between the compressed air source and the first and second inflatable cushions, respectively; and, a control circuit coupled to the first and second valve means for selectively operating the first and second valve means in a pressurizing mode in which the compressed air source is coupled in air flow communication for supplying compressed air to either one or both of the first and second inflatable cushions, and for selectively operating the first and second valve means in a depressurizing mode in which compressed air is released from either one or both of the first and second inflatable cushions.

8. Support apparatus as defined in claim 7, including:

a plurality of timers coupled to the control circuit for enabling operation of the first and second valve means in the pressurizing mode and the depressurizing mode during first and second time intervals, respectively.

9. A method for supporting a patient's forehead and face comprising:

providing first and second inflatable cushions for engaging separate surface areas of the patient's forehead or face;

selectively pressurizing and depressurizing the inflatable cushions so that the separate surface areas of the patient's forehead or face are supported substantially on the first inflatable cushion during a first time interval and then are supported substantially on the second inflatable cushion during a second time interval.

10. A method for supporting a patient's forehead and face as set forth in claim 9, including the steps of pressurizing the first inflatable cushion while venting pressurized air from the second inflatable cushion into the atmosphere.

11. A method for supporting a patient's forehead and face as set forth in claim 9, including the steps of alternately pressurizing and depressurizing the first and second inflatable cushions during a sequence of time intervals as follows:

time interval 1: the first inflatable cushion pressurized, the second cushion vented to atmosphere;

time interval 2: the first inflatable cushion pressurized, the second inflatable cushion pressurized;

time interval 3: the first inflatable cushion vented to atmosphere, the second inflatable cushion pressurized;

time interval 4: the first inflatable cushion pressurized, the second inflatable cushion pressurized;

time interval 5: the first inflatable cushion pressurized, the second inflatable cushion vented to atmosphere.

12. A method for supporting a patient's forehead and face as set forth in claim 9, including the step of alternately pressurizing and depressurizing the first and second inflatable cushions during first and second time intervals, respectively.

13. A method for supporting a patient's forehead and face as set forth in claim 9, including the steps of alternately pressurizing and depressurizing the first and second inflatable cushions during first and second intervals followed by simultaneously pressurizing the first and second inflatable cushions during a third interval, and thereafter reversing the pressurization/depressurization sequence during fourth and fifth intervals, followed by simultaneous pressurization of both of the first and second inflatable cushions during a sixth interval.

* * * * *